US005311984A

United States Patent [19]

Harris

[11] Patent Number: 5,311,984

[45] Date of Patent: May 17, 1994

[54] WRAP-AROUND CARRIER WITH END RESTRAINTS

[75] Inventor: Randall L. Harris, Powder Springs, Ga.

[73] Assignee: Riverwood International Corporation, Atlanta, Ga.

[21] Appl. No.: 84,672

[22] Filed: Jun. 29, 1993

[51] Int. Cl.[5] ..... B65D 75/00

[52] U.S. Cl. ..... 206/140; 206/427; 206/434

[58] Field of Search ..... 206/140, 147, 194, 427, 206/434, 139, 141, 193; 229/40

[56] References Cited

U.S. PATENT DOCUMENTS

| | | | |
|---|---|---|---|
| 3,122,302 | 2/1964 | Wood | 206/140 |
| 3,679,121 | 7/1972 | Morgese | 206/140 |
| 3,680,765 | 8/1972 | Harrelson | 206/140 |
| 3,963,121 | 6/1976 | Kipp | 206/155 |
| 4,029,204 | 6/1977 | Manizza | 206/140 |
| 4,440,340 | 4/1984 | Bakx | 206/434 |
| 5,000,313 | 3/1991 | Oliff | 206/140 |
| 5,060,792 | 10/1991 | Oliff | 206/140 |

*Primary Examiner*—David T. Fidei

[57] ABSTRACT

A wrap-around carrier with gusset panels connected to the bottom panel that automatically fold into their upright position when the bottom panel flaps are set up for locking engagement. The resulting upright portions of the gusset panels contact the bottom portion of adjacent articles in the carrier to prevent the articles from falling out through the ends of the carrier. The fold lines connecting the gusset panels to the side panels are angled back to lengthen these fold lines while cutouts in the gusset panels shorten the length of the other fold lines of the gusset panels. This increases the pulling power of the gusset panels while decreasing the bias force which must be overcome in order for the gusset panels to be folded into their upright position.

8 Claims, 3 Drawing Sheets

WRAP-AROUND CARRIER WITH END RESTRAINTS

FIELD OF THE INVENTION

This invention relates to wrap-around article carriers. More particularly, it relates to wrap-around carriers which have means for preventing the end articles from falling out of the carrier.

BACKGROUND OF THE INVENTION

Wrap-around carriers provide an inexpensive, effective means for packaging articles, requiring blanks of only minimum size which are capable of running on packaging machines at high speeds. A wrap-around carrier is formed by first grouping the articles to be packaged in the same arrangement they will have in the package, then wrapping a carrier blank around the articles and securing the ends of the blank together. Although some wrap-around carriers include integral end panels, most are open-ended. The articles are prevented from falling out through the open ends by tightly wrapping the carrier blank around them and also by designing the package so that the bottom portions of the articles protrude through openings in the side panels of the carrier. For example, cutouts in the side panels are conventionally employed to receive the flanges of cans and other flanged articles, while heel cutouts in the lower portions of the side panels are employed to receive the heels or bases of beverage bottles.

While such measures have been successful in containing bottles of traditional design in their wrap-around carriers, new bottle designs do not always lend themselves to conventional treatment The trend to larger beverage bottles makes it incumbent to employ carriers that are not only structurally capable of supporting heavier loads but are able to positively prevent outward movement of the end bottles. This becomes more difficult when the bottle design is such that it no longer includes a conventionally shaped heel which normally would be held in place by a heel cutout. The packaging of bottles provided with petaloid bottom designs, the bottom portions of which have an inward slope instead of an outward slope, is particularly difficult in this respect.

It would be desirable to be able to employ wrap-around carriers to package bottles and other articles whose design makes it difficult or impossible to be held in place by side panel cutouts, and to do so without danger of the articles sliding out the ends of the carrier.

BRIEF SUMMARY OF THE INVENTION

The wrap-around carrier of the invention is comprised of side panels foldably connected to a top panel and to bottom panel flaps as is well known in the art. In addition, a gusset panel is connected to a portion of each side panel along a first fold line and to each adjacent bottom panel flap along a second fold line. Each gusset panel has an intermediate diagonal fold line dividing the gusset panel into first and second sections, and also includes a cutout at which the first, second and intermediate fold lines terminate. The first fold line is longer than the second fold line, and the end edge portions of each side panel to which the first fold lines of the gusset panels are connected converge toward each other When the first gusset panel sections are folded into contact with the side panels, the second gusset panel sections automatically fold to their upright position where they restrain outward movement of the end articles in the carrier. The folding action of the gusset panels brings one face of the first gusset panel section into contact with the adjacent side panel. A portion of the second gusset panel section lies between the first gusset panel portion and an adjacent article, whereby outward pressure from the article locks the first and second gusset panel portions in place.

The first fold lines are made relatively long, by angling them toward each other on each side of the carrier, and the second fold lines are made relatively short, due to the cutout interrupting them, so as to increase the ability of the first gusset panel sections to cause the second gusset panel sections to fold into their operative positions. An additional fold line may be provided in the second gusset panel section to facilitate curving of the second gusset panel section around the periphery of an adjacent curved or rounded article.

The carrier provides greater structural integrity than carriers employing cutouts, yet requires only a minimum of stock. Set-up of the carriers is simple and rapid, permitting the packaging machine to run at high speeds.

The above and other aspects and benefits of the invention will readily be apparent from the more detailed description of the preferred embodiment of the invention which follows.

DETAILED DESCRIPTION OF THE PREFERRED EMBODIMENT

Figure 1:
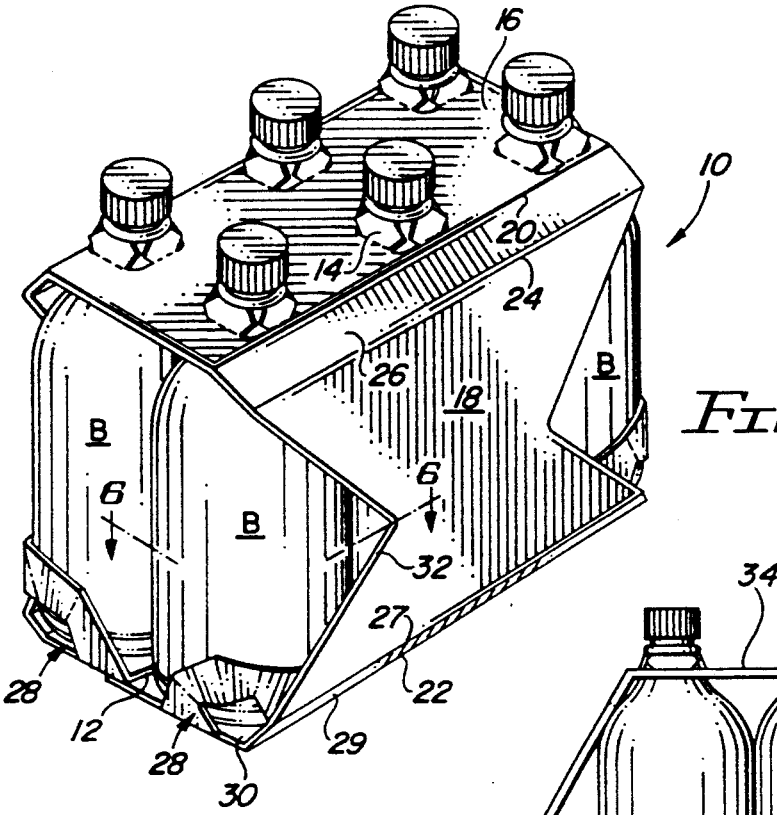
FIG. 1 is a pictorial view of the carrier of the invention.

Referring to FIG. 1, the wrap-around carrier 10 is illustrated in connection with six beverage bottles B supported on bottom panel 12 and extending up through neck openings 14 in top panel 16. Side panels 18 are connected to the top panel along fold lines 20 and to the bottom panel along fold lines 22. Fold lines 24, which are parallel to and spaced a short distance from the fold lines 20, form a smaller upper sloped panel portion 26 within the side panels 18. The sloped panel portion 26 contacts the sloped portions of the bottles between the neck and barrel to hold the bottles securely in this area. Similarly, fold lines 27, which are parallel to and spaced a short distance from the fold lines 22, form a small lower sloped panel portion 29, which contacts the angled bottom portion of bottles shaped in this manner. Although the invention is of special significance to the packaging of bottles or other articles having angled bottom portions, often of petaloid shape, it will be obvious from the following description that the carrier of the invention may be employed to package articles which are not so shaped. In that event, it would not be necessary to provide the lower sloped portion of the side panels. End gusset panels 28 are connected to the bottom panel along fold lines 30 and to the side panels 18 along fold lines 32 coinciding with the lower sloped end edges of the side panels 18.

Figure 2:
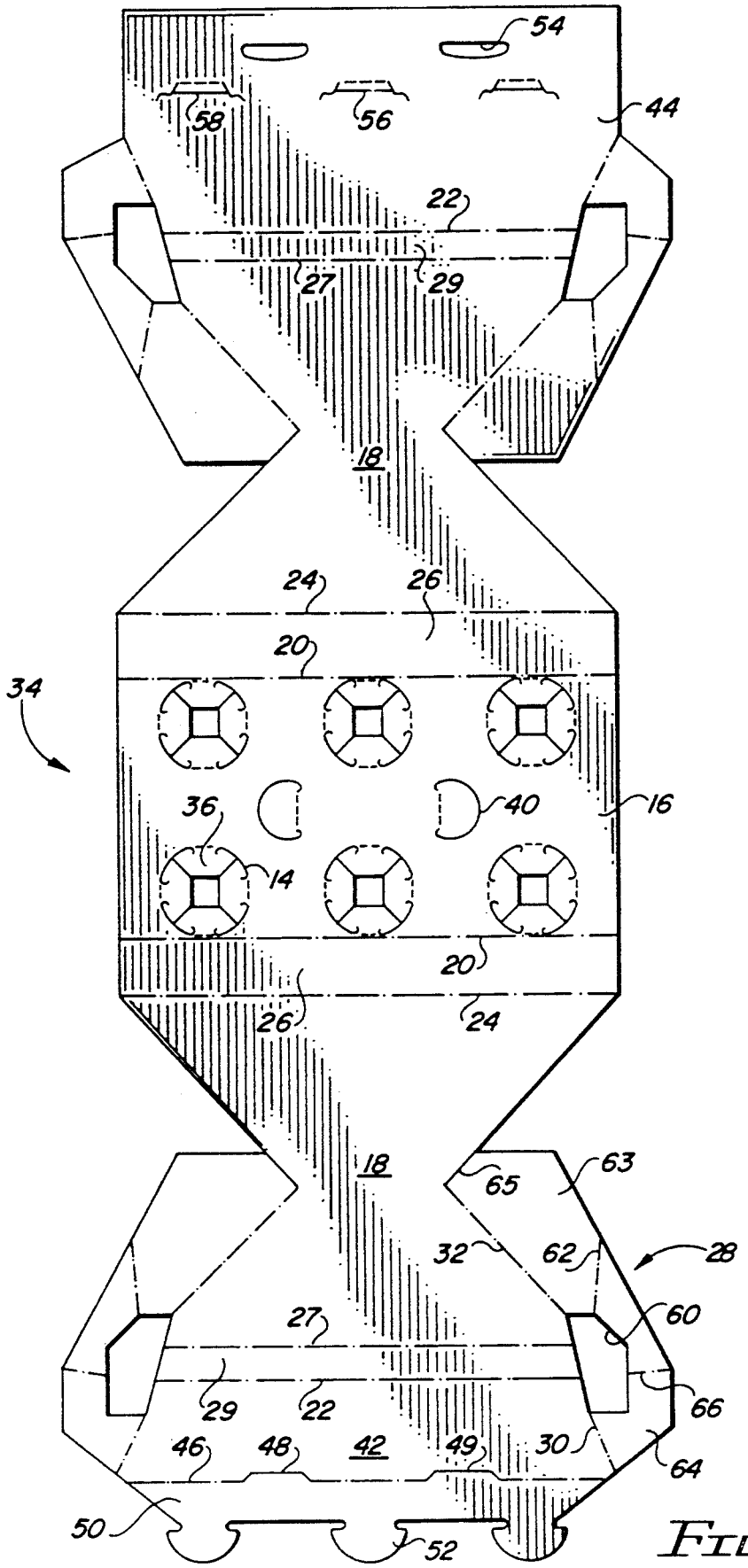
FIG. 2 is a plan view of a blank used to form the carrier.

Referring now to FIG. 2, wherein like reference numerals to those used in FIG. 1 denote like elements, a blank 34 capable of being fabricated into the carrier of FIG. 1 is comprised of a central top panel section 16 connected at opposite sides by fold lines 20 to the sloped side panel sections 26. The top panel section includes the openings 14 which are surrounded by foldably connected tabs 36 for receiving the necks of bottles packaged in the carrier. Finger holes formed by slits 40, or any other suitable handle, may be provided for lifting the carrier. If the articles to be packaged do not have necks or are otherwise shaped so as not to extend through the top panel, the openings 14 would not be provided.

The fold lines 22 connect the lower sloped side panel portions 29 to bottom panel flaps 42 and 44. The bottom panel flap 42 includes a fold line 46 which extends the full length of the flap and which is interrupted by primary male locking tabs 48 formed by slits 49. The portion 50 of the flap 42 lying outwardly of the fold line 46 constitutes a locking panel which includes secondary male locking tabs 52. The bottom panel flap 44 includes cutouts having primary female locking edges 54 adapted to engage the primary male locking members 48 and slits 56 adapted to receive the secondary locking tabs 52. Tabs 58 are foldably connected to the bottom panel flap 44 a short distance outwardly of the slits 56 to facilitate entry of the locking tabs 52 into the slits. These various locking elements are illustrated to demonstrate a typical bottom panel locking arrangement suitable for use with the carrier of the invention, but it should be understood that any desired effective form of bottom panel locking means may be employed.

Still referring to FIG. 2, the fold lines 30 connecting the gusset panels 28 to the bottom panel flaps and the fold lines 32 connecting them to the side panels 18 terminate at a cutout 60. In addition, the gusset panels also include an intermediate fold line 62 which extends from the outer edge of the gusset panel to the cutout, dividing the gusset panel into two sections 63 and 64. The gusset panel section 63 is thus bounded by its outer edges, the fold lines 62 and 32, a portion of the perimeter of the cutout 60 and a slit 65 separating a short segment of the gusset panel section from the side panel 18. Similarly, the gusset panel section 64 is bounded by its outer edges, the fold lines 62 and 30 and a portion of the perimeter of the cutout 60. The gusset panel section 64 also includes an additional fold line 66 which extends from the outer edge of the gusset panel to the cutout 60 at an angle which bisects the angle formed by the fold lines 62 and 30. The fold lines 32 extend at an acute angle to the fold lines 27, converging toward each other on each side of the carrier, narrowing the width of the side panels to their closest distance apart, for a reason explained below.

Figure 3:
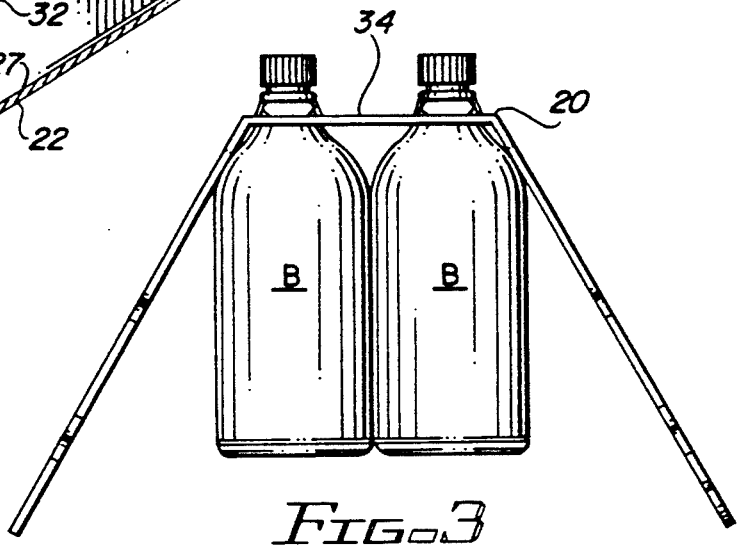
FIG. 3 is an end view of the blank in an initial stage of carrier formation after being placed over a group of bottles and initially folded.
Figure 4:
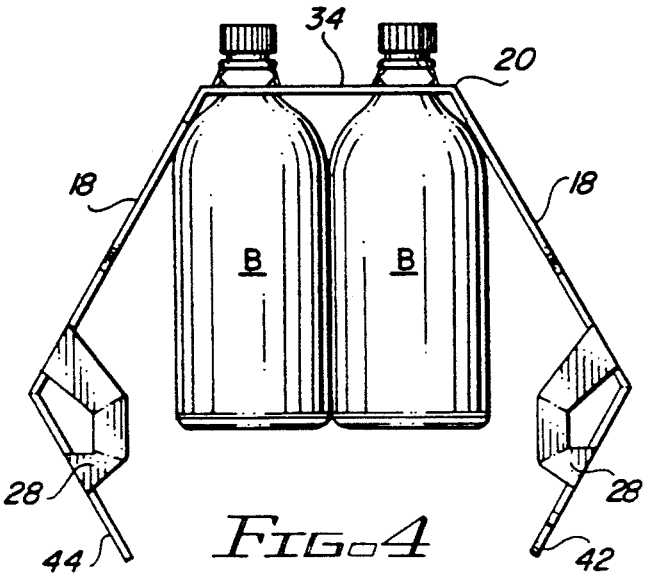
FIG. 4 is an end view similar to that of FIG. 3, but showing the blank in the process of being folded into bottom panel locking position.

To form a package of bottles, the bottles are grouped together as they are to be arranged in the package and the top panel section of the blank 34 is placed on top of them, with the necks of the bottles extending through the bottle neck openings 14, as illustrated in FIG. 3. The blank is shown as being in a preliminary interim condition, folded down about the fold lines 20, with the side panel sections, the gusset panels and the bottom panel sections still in the same planar relationship as in FIG. 2. The gusset panel sections 63 are then folded in about fold lines 32 and held in place while the blank is folded along the fold lines 22 and the ends of the blank are moved toward each other into bottom panel locking position. As shown in FIG. 4, which illustrates a later interim position of the blank during the carrier forming process, folding of the gusset panel sections 63 causes the gusset panel sections 64 to fold up out of the plane of the blank. The gusset panel sections 63 are engaged and moved by suitable packaging machine elements in order to fold the gusset panels into this position. Neither the packaging machine itself nor the folding elements of the machine have been shown since the various mechanical movements required in order to fold the panels of a carrier into place are well within the scope of one skilled in the packaging machine art.

Figure 5:
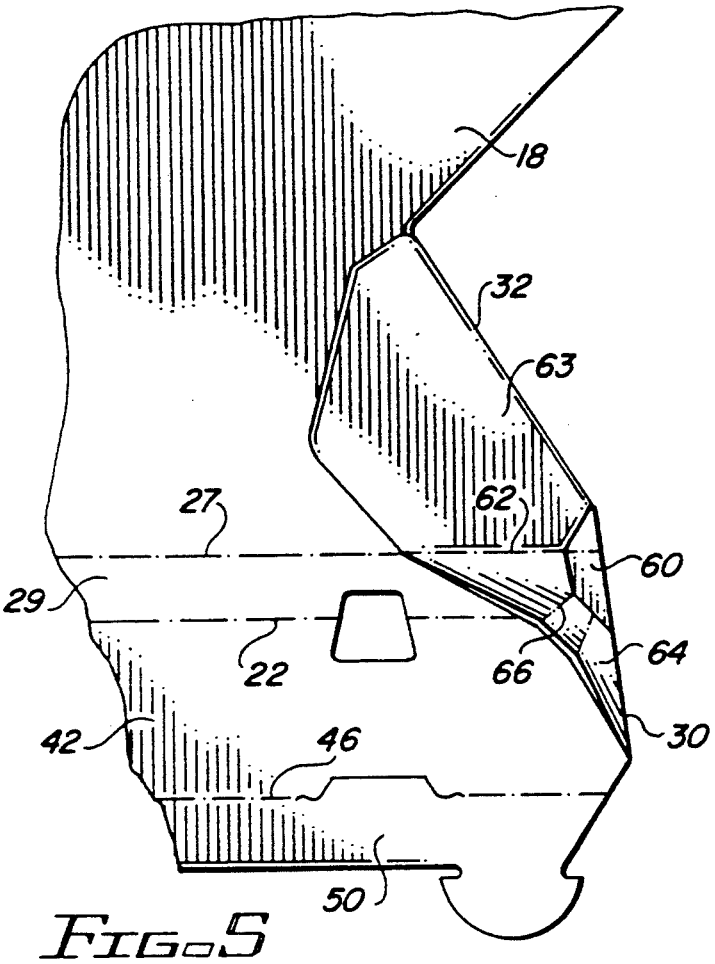
FIG. 5 is a side view of the interior face of one of the side panels and connected bottom panel flap of the carrier blank of FIG. 4, with the bottles omitted for the sake of clarity.
Figure 6:
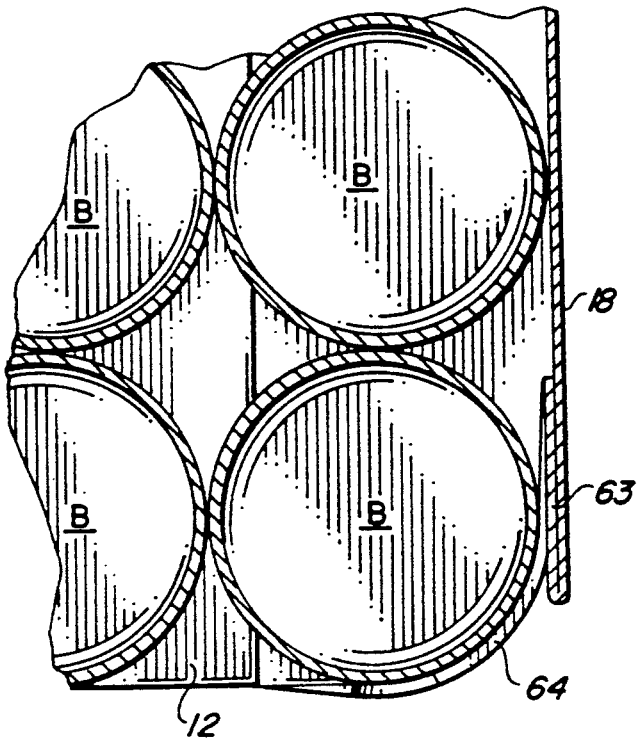
FIG. 6 is an enlarged partial longitudinal sectional view of the carrier taken a short distance above the bottom panel of the carrier of FIG. 1 along the line 6—6 of FIG. 1, showing a folded gusset panel in relation to the bottom of an adjacent packaged bottle.

Referring to FIG. 5, the folding of the gusset panel sections is illustrated in more detail. The section 63 is shown after it has been folded about fold line 32 to bring it into face-to-face relationship with the side panel 18. This folding step causes the gusset panel section 64 to fold up about fold lines 62 and 30 and down about fold line 66. When the gusset panels in the interim position of FIG. 5 contact the adjacent end bottle in the group being packaged, the portion of the gusset panel section 64 adjacent the fold line 62 folds in between the gusset panel section 63 and the bottle, with the fold line 62 being located on or slightly above the fold line 27. When the bottom panel is locked in place, the pressure of the end bottles against the gusset panel sections 64 holds the gusset panels in folded position, which maintains the gusset panel section 64 in its final upright condition. This is further illustrated in connection with the final carrier in FIG. 6. The relatively slight folding of the gusset panel section 64 about fold line 66 enables the gusset panel section to follow the curved surface of the adjacent bottle to more securely hold the end bottles in place.

As previously noted, the illustrated embodiment of the invention is designed to carry bottles or other articles having inwardly sloped bottom portions. The location of the fold 62 at or slightly above the fold line 27 thus assures contact between the side of the adjacent bottle above the sloped bottom portion and the fold. It should be apparent that if the carrier were designed to hold articles which do not have inwardly sloped bottom portions, the fold line 27 would be eliminated and the fold 62 would be located at or slightly above the fold line 22.

The final step in the formation of the package is to lock the bottom panel flaps together. The details of this phase of the operation have not been illustrated since the particular locking mechanism employed does not form part of the invention. It will be understood by those familiar with the locking elements shown, however, that the outer flap portion or locking panel 50 of the bottom panel flap 42 is folded back about the fold line 46 and the primary male locking tabs 48 are engaged with the primary female locking edges 54 in bottom panel flap 44. The secondary male locking tabs 52 are then inserted through the slits 56 to complete the mechanical locking action, resulting in the package of FIG. 1.

Although the invention has been described in connection with a carrier designed to hold six bottles, it may be incorporated into carriers designed to hold more or less than that and can be utilized with articles of various sizes. Regardless of the specific design of the carrier, the principles of the invention would remain the same, with the gusset panel sections connected to the bottom panel flaps being automatically moved into their final position by the folding of the gusset panel section connected to the side panels. The length of the fold line 32 should be maximized, since the greater its length the more pulling power the gusset panel section 63 has when it is folded over about the fold line 32. The term "pulling power" as used in this sense refers to the ability of the gusset panel section 63 as it is pivoted about the fold line 32 to pull the gusset panel section 64 with enough force to cause it to fold about the fold lines 62, 66 and 30 and follow the contour of the end bottle. The preferred way to maximize the length of the fold lines 32 is to angle the fold lines on each of the side panels back toward each other as shown in FIG. 2. By increasing the length of the fold line 32 deep into the associated side panel, the width of the carton blank in the gusset area is minimized, thereby requiring less paperboard or other blank material. It also exposes the end bottles to view, allowing customers to see the contour of the bottle while still in the package. This is an important feature to producers of products who want their product to be identified with specially shaped bottles or other containers in the carrier. While a wide range of angles and fold line lengths may be available for any particular carrier design, obviously, the fold lines 32 cannot be angled so sharply and made so long that the side panels are in danger of tearing at their narrowest point.

In addition to maximizing the length of the fold line 32, the relative pulling power of the gusset panel section 63 is further enhanced by minimizing the length of the fold line 30, thereby decreasing the resistance to folding of the gusset panel section 64. The cutout 60 accomplishes this by interrupting the fold line 30, thereby making it shorter. At the same time, the cutout also shortens the fold lines 62 and 66 to further decrease the resistance to folding of the gusset panel section 64. The cutout provides the additional advantage of removing material from the area surrounding the point at which the various fold lines of the gusset panel sections would intersect, which greatly facilitates the folding of the gusset panels.

The gusset panels are further made to pull tightly against adjacent bottles by designing the gusset panels so that extensions of the fold lines 62 and 30 intersect inside the outer edge of the carrier. That is, the distance between the points of intersection of these fold line extensions associated with either side panel is less than the distance between the end edges of the top panel. This also minimizes the width of the blank.

The angles at which the fold lines 62 and 30 extend are selected so that the fold lines 62 lie at or slightly above the fold line 27 and the fold lines 30 are aligned with the bottom panel of the carrier, parallel to the top panel. Since these angles will change as the dimensions of the carrier change, they cannot be precisely given for all embodiments of the invention. Those skilled in the art will readily be able to determine the angles of these fold lines for any particular carrier design. In any event, the fold lines 62 should be long enough to extend past the midpoint of the adjacent outer bottle in the package. For a bottle of circular cross-section, this is the point on the side panel at which the radius of the bottle forms a right angle with the side panel. If it terminates short of that point, the gusset panel section 63 will not be held in place by the bottle.

It can be appreciated that the invention not only provides a carrier with end gusset panels for holding bottles in place instead of utilizing side panel heel cutouts, but employs a design which automatically activates the end gusset panels when the bottom panel flaps are moved into position to be locked together, permits use of a blank of minimal size and allows the end articles in the package to be viewed substantially in their entirety.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention as defined in the appended claims.

What is claimed is:

1. A wrap-around carrier containing a plurality of articles, comprising:

opposite side panels, each side panel being connected along an upper fold line to a top panel and along a lower fold line to a bottom panel flap, the bottom panel flaps being connected to each other to form the bottom panel of the carrier;

a gusset panel connected to a portion of each end edge of the side panels along a first fold line and connected to each end edge of an adjacent bottom panel flap along a second fold line;

each gusset panel having an intermediate diagonal fold line dividing the gusset panel into a first section extending between the intermediate fold line and said first fold line and a second portion extending between the intermediate fold line and said second fold line;

each gusset panel including a cutout at which the first, second and intermediate fold lines terminate;

the first fold line being longer than the second fold line; and the end edge portions of each side panel to which the first fold lines of the gusset panels are connected converging toward each other;

each gusset panel being folded about its first, second and intermediate fold lines so that one face of the first gusset panel section is in contact with the adjacent side panel and a portion of the opposite face of the first gusset panel section is in contact with a portion of the second gusset panel section, another portion of the second gusset panel section extending upwardly from its associated bottom panel flap, whereby lower side portions of the articles adjacent the gusset panels contact both portions of the second gusset panel sections;

at least a substantial portion of the cutout being located in the upwardly extending portion of the second gusset panel section.

2. A wrap-around carrier as defined in claim 1, wherein the articles comprise beverage bottles having cylindrical body portions and necks which extend up through openings in the top panel.

3. A wrap-around carrier as defined in claim 1, wherein the second gusset panel sections include an intermediate fold line terminating at the cutout, the intermediate fold line facilitating the second gusset panel sections to follow the curvature of adjacent rounded articles in the carrier.

4. A wrap-around carrier as defined in claim 1, wherein each side panel includes an additional fold line parallel to and spaced above the lower fold line connecting the side panel to a bottom panel flap, the portion of the side panels between the lower and additional fold lines being inwardly sloped to follow the contour of adjacent articles having inwardly sloped lower portions, the intermediate diagonal gusset panel fold line being located substantially parallel to, and at or slightly above, the additional fold line of the side panels.

5. A blank for forming a wrap-around carrier for packaging a plurality of articles, comprising:

a top panel section connected along fold lines at opposite sides thereof to side panel sections;

each side panel section connected along a fold line to a bottom panel flap, the bottom panel flaps being adapted to be connected to each other to form the bottom panel of a carrier formed from the blank;

a gusset panel connected to a portion of each end edge of the side panels along a first fold line and connected to each end edge of an adjacent bottom panel flap along a second fold line;

each gusset panel having an intermediate diagonal fold line dividing the gusset panel into a first section extending between the intermediate fold line and said first fold line and a second portion extending between the intermediate fold line and said second fold line;

each gusset panel including a cutout at which the first, second and intermediate fold lines terminate;

the first fold line being longer than the second fold line; and the end edge portions of each side panel to which the first fold lines of the gusset panels are connected converging toward each other;

each gusset panel being adapted to be folded about its first, second and intermediate fold lines so that one face of the first gusset panel section is in contact with the adjacent side panel of a carrier formed from the blank and a portion of the opposite face of the first gusset panel section is in contact with a portion of the second gusset panel section, another portion of the second gusset panel section extending upwardly from its associated bottom panel flap, whereby lower side portions of articles in the carrier adjacent the gusset panels contact both portions of the second gusset panel sections and at least a substantial portion of the cutout being located in the upwardly extending portion of the second gusset panel section.

6. A blank for forming a wrap-around carrier as defined in claim 5, wherein the second gusset panel sections include an intermediate fold line terminating at the cutout, the intermediate fold line facilitating the second gusset panel sections to follow the curvature of adjacent rounded articles in a carrier formed from the blank.

7. A blank for forming a wrap-around carrier as defined in claim 5, wherein each side panel includes an additional fold line parallel to and spaced from the lower fold line connecting the side panel to a bottom panel flap, the portion of the side panels between the lower and additional fold lines being inwardly sloped in a carrier formed from the blank to follow the contour of adjacent articles having inwardly sloped lower portions, the intermediate diagonal gusset panel fold line being located substantially parallel to, and at or slightly above, the additional fold line of the side panels in a carrier formed from the blank.

8. A blank for forming a wrap-around carrier as defined in claim 5, wherein the intermediate diagonal fold line and the second fold line of the gusset panels at each end of the blank, if extended, intersect at points spaced apart a distance less than the length of the top panel section, as measured between opposite end edges of the top panel section.

* * * * *